US007882980B1

(12) United States Patent
Horn et al.

(10) Patent No.: US 7,882,980 B1
(45) Date of Patent: Feb. 8, 2011

(54) SANITARY LID DISPENSER

(76) Inventors: Terry Horn, 9001 S. Cimarron Rd., Mustang, OK (US) 73064; Jerry Horn, 9001 S. Cimarron Rd., Mustang, OK (US) 73064

( * ) Notice: Subject to any disclaimer, the term of this patent is extended or adjusted under 35 U.S.C. 154(b) by 351 days.

(21) Appl. No.: 12/218,389

(22) Filed: Jul. 15, 2008

(51) Int. Cl.
*G07F 11/04* (2006.01)

(52) U.S. Cl. ..... 221/226; 221/2; 221/209; 221/221

(58) Field of Classification Search ..... 221/2, 221/4–6, 9, 13, 14, 17–20, 69, 92, 123, 124, 221/131, 175, 176, 178, 186, 188, 197, 198, 221/208, 211, 224, 226, 227, 230, 231, 236, 221/237, 258, 277, 279, 312 R, 312 A
See application file for complete search history.

(56) References Cited

U.S. PATENT DOCUMENTS 892,688 A * 7/1908 Schrum ..... 194/251
2,215,850 A 9/1940 Holdman
2,427,628 A * 9/1947 Silverman ..... 221/123
3,369,697 A * 2/1968 Glucksman et al. ..... 221/9
4,643,334 A 2/1987 Steele
4,858,783 A 8/1989 Mayfield, III
5,012,952 A 5/1991 Franz
5,477,983 A * 12/1995 Davis ..... 221/279
5,944,220 A * 8/1999 Garske et al. ..... 221/312 A
5,975,839 A 11/1999 Ashby
6,082,580 A * 7/2000 Mueller et al. ..... 221/226
6,474,503 B2 11/2002 Davis
6,659,305 B2 12/2003 Thompson
7,207,462 B2 4/2007 Gunderson
7,337,919 B2 3/2008 Walsh
D608,122 S * 1/2010 Horn et al. ..... D6/515
7,669,732 B2 * 3/2010 Njaastad ..... 221/255
2006/0226169 A1 * 10/2006 Davis et al. ..... 221/211
2007/0131705 A1 * 6/2007 Behravesh et al. ..... 221/130

* cited by examiner

*Primary Examiner*—Gene Crawford
*Assistant Examiner*—Kelvin L Randall, Jr.
(74) *Attorney, Agent, or Firm*—Ronald D. Homburg

(57) ABSTRACT

A dispensing device for beverage cup lid which prevents excessive human contact with the lid prior to insertion upon the beverage cup, the device providing a central stationary lid retaining rod suspended from a lid cabinet upon which a stacked plurality of lids are retained through a central bore, the lids urged downward by a traveling press plate engaging a rotating threaded shaft, the threaded shaft moving the press plate against the uppermost lid on the retaining rod pressing the stacked plurality of lids down along the retaining rod in increments programmed to release only the lowermost lid from the end of the retaining rod onto the top of a beverage cup positioned below the retaining rod. The device is operated by the activation of a presence sensor, either a beverage cup or a clean hand, which causes the incremental dispensing of a single lid.

10 Claims, 4 Drawing Sheets

SANITARY LID DISPENSER

CROSS REFERENCE TO RELATED APPLICATIONS

None

I. BACKGROUND OF THE INVENTION

1. Field of Invention

A dispensing device for beverage cup lid which prevents excessive human contact with the lid prior to insertion upon the beverage cup, the device providing a central stationary lid retaining rod suspended from a lid cabinet upon which a stacked plurality of lids are retained through a central bore, the lids urged downward by a traveling press plate engaging a rotating threaded shaft, the threaded shaft moving the press plate against the uppermost lid on the retaining rod pressing the stacked plurality of lids down along the retaining rod in increments programmed to release only the lowermost lid from the end of the retaining rod onto the top of a beverage cup positioned below the retaining rod. The device is operated by the activation of a presence sensor, either a beverage cup or a clean hand, which causes the incremental dispensing of a single lid.

2. Description of Prior Art

The following United States patents were discovered and are disclosed within this application for utility patent. All relate to devices which provide for the dispensation of a drink cup lid, either manually or by operation of a mechanical means. A recent U.S. Pat. No. 7,337,919 to Walsh, a manually operated beverage lid dispenser indicates a contained stack of lids within a cylinder which are horizontally separated from a stack by gravity, one at a time, and horizontally moved by a slide plate which contains the single separated lid and draws it out from beneath the stack for presentation in an inverted position. One must use their hand to remove the lid and right it for application to a beverage cup. Similar devices are disclosed in U.S. Pat. No. 6,474,503 to Davis for drink lids and U.S. Pat. No. 5,975,839 to Ashby for disks, primarily stacked recording media.

A spring is used to push cups and lids upward in a cylindrical stack in U.S. Pat. No. 4,858,783 to Mayfield, III. A similar spring type device is used for the horizontal thrust and presentation of beverage lids in both U.S. Pat. Nos. 5,012,952 to Franz and 7,207,462 to Gunderson. A mechanical device segregates a single lid from a stack and slides the lid through a slot in the device framework by the rotation of a plurality of gears which separate, grasp and move the lid from its stacked position to the slot by some manually activated means in U.S. Pat. No. 6,659,305 to Thompson. Two simple stacked cylindrical lid dispensing devices are disclosed in U.S. Pat. Nos. 4,643,334 to Steele and 2,215,850 to Holdeman.

None of the above devices places a stacked group of lids on a central stationary retaining rod, they do not involve a rotational drive shaft which applied force to the top of the stacked lids to force the stack downward in a programmed incremental distance to release a single lid, and they do not provide an option for the dispensing of a lid without human contact with the lid prior to being applied to the cup. They also do not disclosed the components similar to the present device to load and unload the lids nor the sensors applied to activate the motion of the device.

II. SUMMARY OF THE INVENTION

In the food and beverage industry, the potential for contamination of foods and beverages by food handlers has received much attention. Bacteria, viruses and sometimes just plain filth may be passed onto a customer by a food handler or by items which come into contact with food and beverages. Illness and sickness can result, and in rare instances, even death through food poisoning, *E. Coli* contamination or hepatitis. Reducing the amount of human contact with food or beverages and their service containers has been demonstrated to proportionally reduce the risks.

Most commercially available beverage and food containers are presented as a cup or bowl which has a plastic lid which engages the perimeter of the cup or bowl. In conventional lid dispensers, where provided, a server or customer is required to grab a lid out of an open dispenser, coming into contact with at least one lid, but often several when sorting through the find the right size or shape. It could be possible that a single lid in this type dispensary could have been touch by more than one person whose hygiene might range from very recently clean to horrible filthy. It could only be imagined just how dirty a "clean" lid could become under these circumstances. Thus, a touch free lid dispenser which dispenses a lid onto a container or into the consumer's hand for placement upon a container would be desired to further a food and beverage provider's goal of providing sanitary lids to their customers The primary objective of the invention is to provide a device which provides and dispenses a single sanitary beverage or bowl lid to a customer with a minimal amount of exposure to contact with non-sanitary people. A second objective is to provide the device with a presence sensor to cause the dispensing of a single stacked lid without requiring contact with the single lid until after being dispensed. A third objective is to provide the device to be refilled with a stacked plurality of sanitary lids on a central stationary rod with a press plate urging the top most lid down the stationary rod to apply a uniform pressure on the lid to reduce any potential deformation of the sanitary lid as it being dispensed from the device. A forth objective is to provide the device to have all controllers and sensors within an integrated circuitry area segregated from a drive and dispensing area containing the drive mechanisms, moving parts, sanitary lids and other mechanical hardware.

III. DESCRIPTION OF THE DRAWINGS

The following drawings are submitted with this utility patent application.

FIG. 6 is a cross sectional view of a stack of lids and the distal end of the stationary retaining rod, demonstrating the plurality of grooved indentation segregating each lid for single lid dispensation upon the application of the incremental force applied to the top of the stack of lids.

IV. DESCRIPTION OF THE PREFERRED EMBODIMENT

Figure 1:
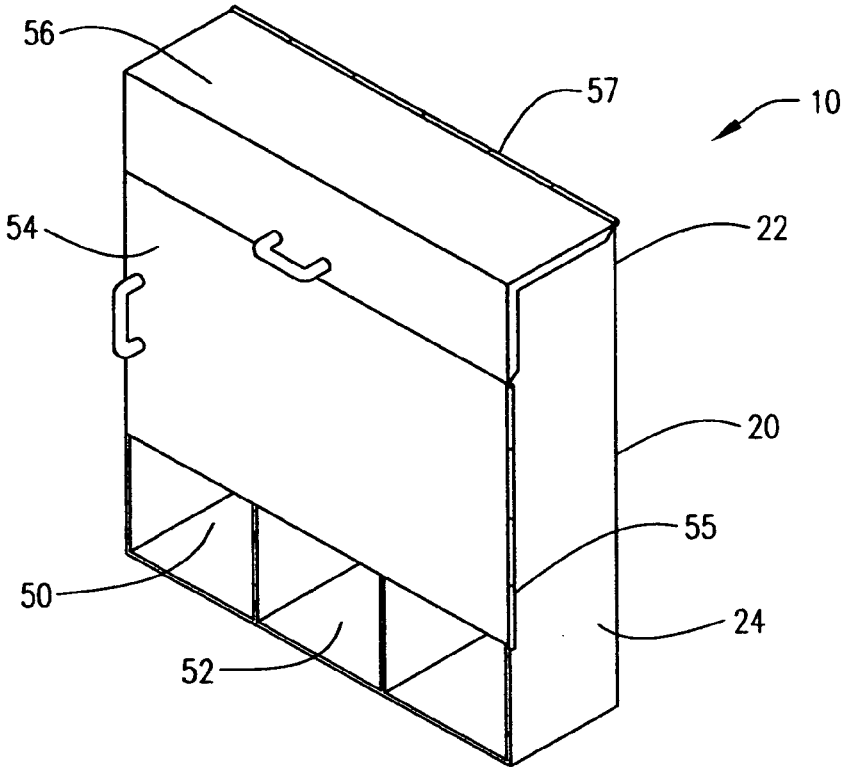
FIG. 1 is a front perspective view of the sanitary lid dispenser with the front access panel closed.
Figure 2:
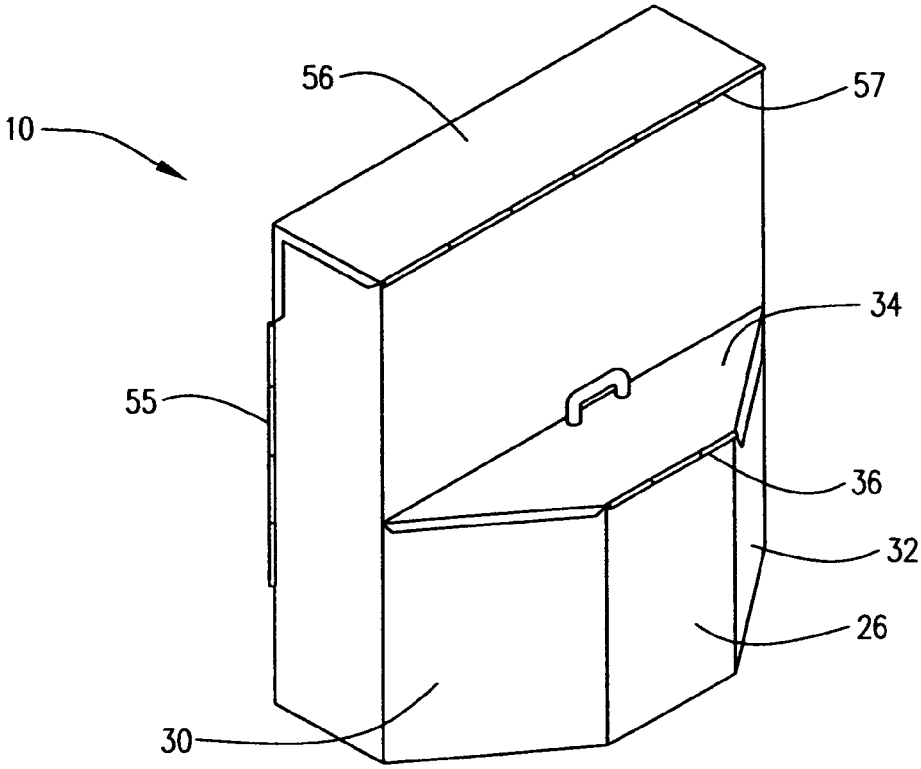
FIG. 2 is a rear perspective view of the lid dispenser with the rear controller compartment closed.
Figure 3:
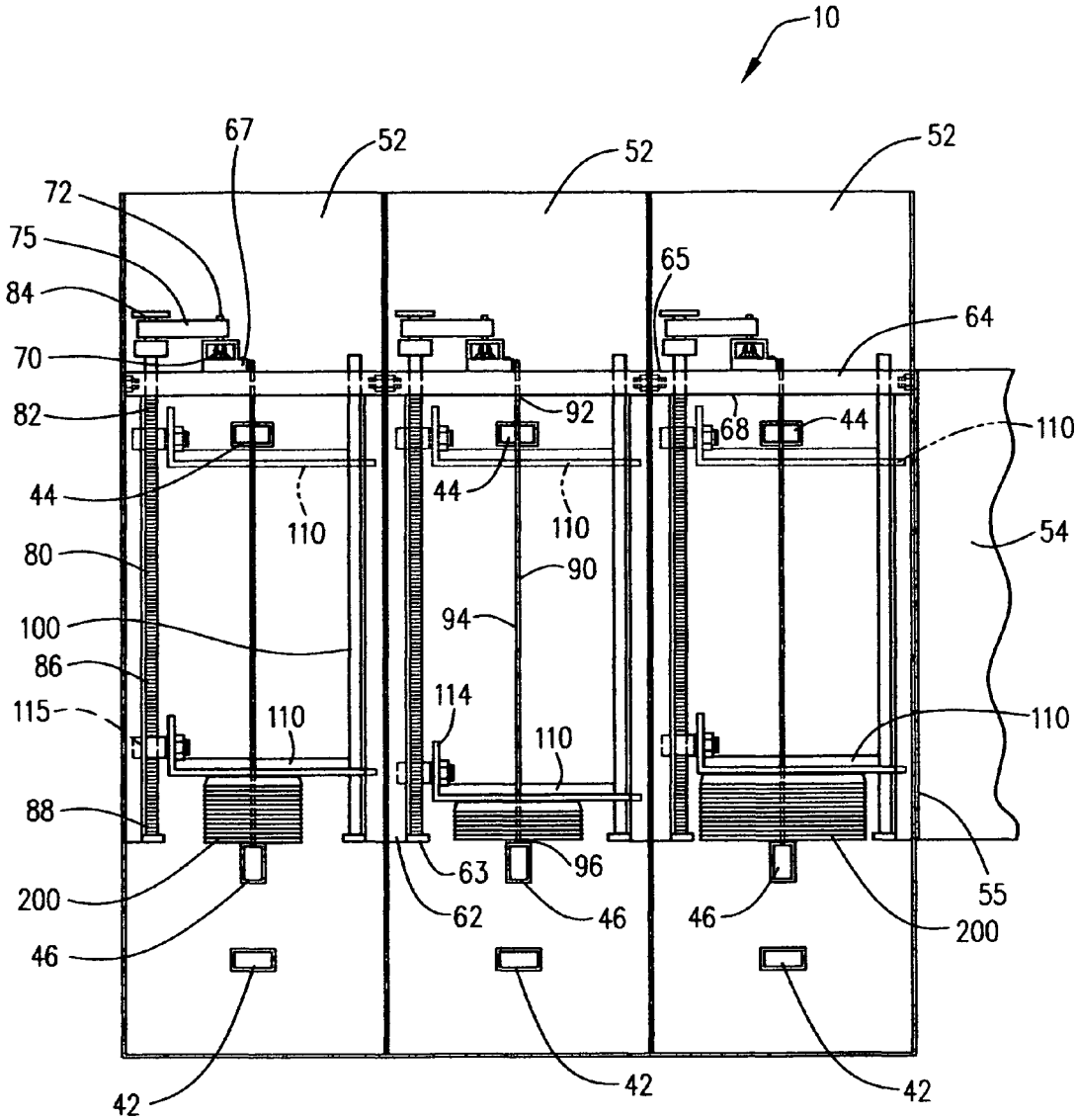
FIG. 3 is a front view of an embodiment of the lid dispenser with the front access panel open, revealing three vertical lid dispensing compartments for three different sized beverage lids.
Figure 4:
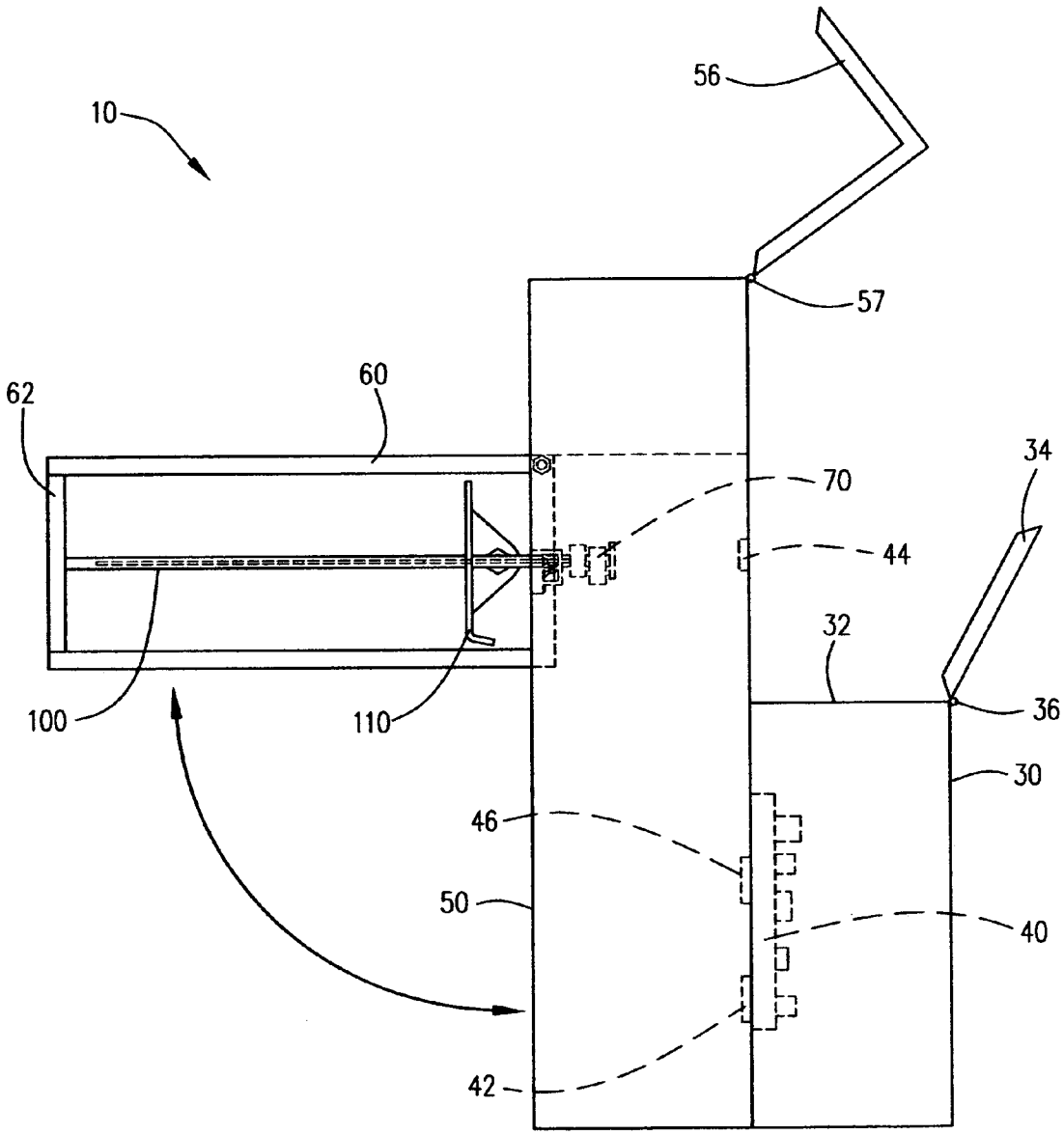
FIG. 4 is a side view of the lid dispenser with the compartments open and the interior lid dispensing frame elevated to a horizontal lid loading position.
Figure 3:
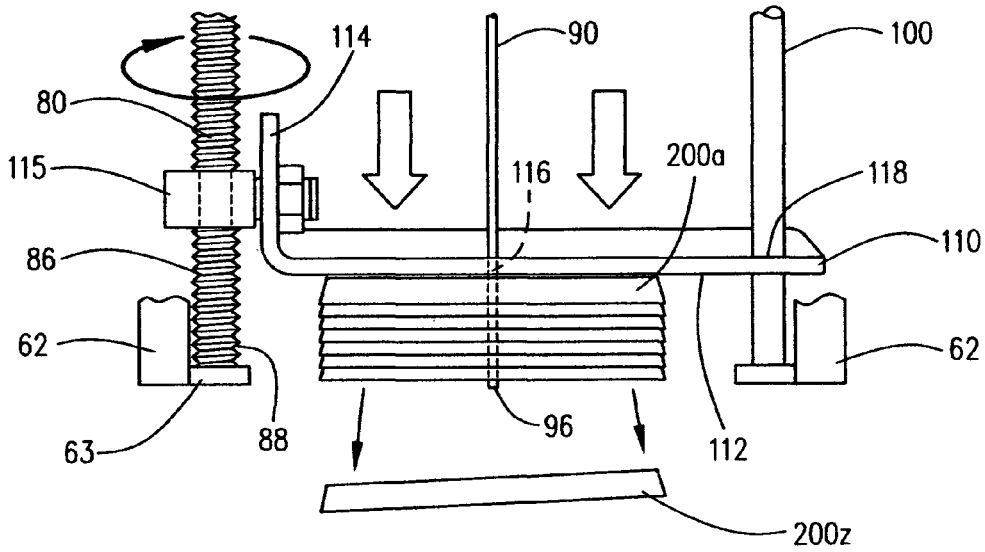
Figure 5:
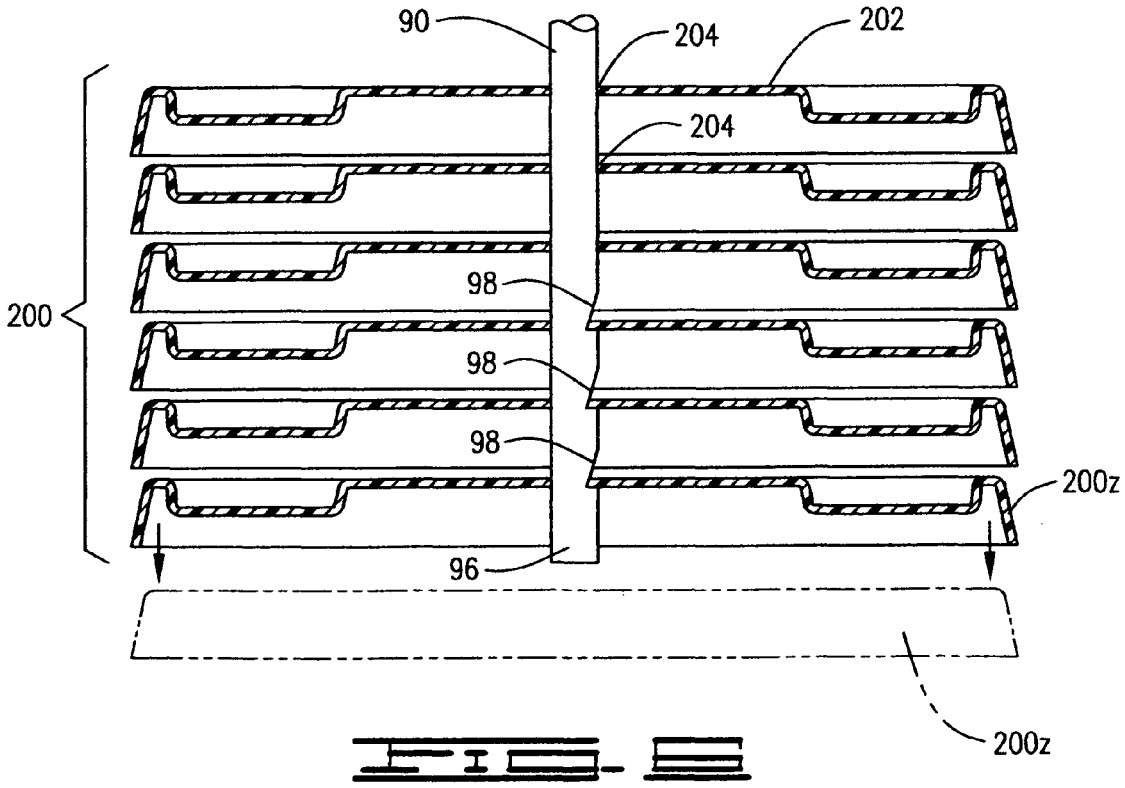
FIG. 5 is a close up front view of the press plate above a stack of sanitary lids applying pressure to the top of the stack in a programmed increment to force one lid from the stationary retaining rod.

A sanitary lid dispensing device 10 providing a sanitary lid 200 to a beverage container without contact by a person serving the beverage, comprising a frame structure 20 having a front service enclosure 50 defining at least one service compartment 52 with a side door 54 having a side hinge 55 attaching the side door 54 to a side 24 of the frame structure 20, FIG. 1, an upper door 56 which has an upper hinge 57 attaching the upper door 56 to an upper end 22 of the frame structure 20, FIG. 4, and a rear controller enclosure 30 defining a controller compartment 32 with a controller access door 34 having an upper hinge 36 attaching the access door 34 to a rear panel 26 of the rear controller enclosure 26, FIG. 2, the controller compartment 32 containing the operational electronic components 40 providing the electrical relays, timers, breakers sensor relays, transformer and electrical wiring required to operate the device 10, FIG. 4, the at least one service compartment 52 further comprising an internal frame member 60, FIG. 3, having an upper frame support platform 64 having an upper surface 66 upon which is mounted a two directional motor 70 within a motor cage 67, the motor 70 having an upper spindle 72 above the motor cage 67, a lateral threaded drive shaft 80 having an upper pulley 84 connected to the upper spindle 72 of the motor 70 by a drive belt 75, the drive shaft 80 being mounted in a vertical position and having an outer thread 86 along the drive shaft 80 with a lower end 88 of the drive shaft 80 rotatably secured within a lower flange 63 of a lower end 62 of the internal frame member 60 and an upper end 82 of the drive shaft 80 rotatably secured within an upper flange 65 on the upper frame support platform 64 of the internal frame member 60, a stationary central retaining rod 90 having an upper end 92 welded to a lower surface 68 of the upper frame support platform 64, the retaining rod 90 further defining a smooth shaft portion 94 with a lower end 96 having a plurality of grooved indentations 98, FIG. 6, each indentation 98 spaced apart at an even distance equal to the distance between a top 202 of each of a plurality of stacked sanitary lids 200 having a central bore 204 inserted upon the retaining rod 90 forming the stack, a lateral stationary support rod 100 attached between the lower surface 68 of the upper frame support platform 64 and the lower end 62 of the internal frame member 60, a press plate 110 having a flat lower surface 112 and a side bracket 114 having an internally threaded drive ring 115 which is threadably engaged to the outer thread 86 of the threaded drive shaft 80 traveling vertically up or down the threaded drive shaft 80 as the shaft rotates, the press plate 110 further providing a central hole 116 which glides along the retaining rod 90 without contact and a lateral bore 118 which moves along the lateral stationary support rod 100, the lateral support rod 100 maintaining the press plate 110 in a horizontal position during its movement within the internal frame member 60, a presence sensor 42 located within the service compartment 52 below the internal frame member 60 which, when activated, sends a signal to the operational electronic components 40 causing the motor 70 to rotate the threaded drive shaft 80 in a programmed incremental amount, urging the press plate 110 downward against a top lid **200*a* in the plurality of stacked sanitary lids 200, FIG. 5, forcing the plurality of stacked lids 200 downward along the retaining rod 90, and expelling a lowest lid 200*z* in the plurality of stacked lids 200 from the retaining rod 90 onto a beverage container placed below the lower end 96 of the retaining rod 90 within the service compartment 52**.

The entire internal frame member 60 is pivotally attached within the service compartment 52 at the upper support frame member 64, FIG. 4. The device 10 should not operate while the internal frame member 60 is pivoted outside the service compartment 52, as shown in FIG. 4. The device 10 may also be selectively inoperable when one or more of the upper door 56, side door 54 or controller access door 34 is open.

The device 10 may also include a lower plate sensor 46 which send a signal alert to the operational electronic components 40 to notify an operator of the device when the top lid **200*a* has been dispensed with the lower plate sensor 46 being activated by the presence of the press plate 110 at a lowest point of travel along the threaded drive shaft 80 and the retaining rod 90 with the central hole 116 of the press plate 110 never allowed to be disengaged from the lower end 96 of the retaining rod 90, retracting the press plate 110 to an uppermost fully retracted position closest to the lower surface 68 of the upper frame support platform 64. It is also contemplated that the device 10 may also include an upper plate sensor 44 to indicate when the press plate 110 is fully retracted and ready for a refill of a fresh stacked plurality of sanitary lids 200 upon the retaining rod 90**.

To reload the device with another stacked plurality of sanitary lids 200, the internal frame member 60 would be pivoted outward from the respective service compartment 52 into a horizontal position, FIG. 4, and the fresh stacked plurality of sanitary lids 200 would be forced upon the retaining rod 90 by placing the lower end 96 of the retaining rod 90 through each central bore 204 of each stacked sanitary lid 200 until the retaining rod 90 is full of the fresh stacked plurality of sanitary lids 200 and the top sanitary lid **200*a* is against the lower surface 112 of the press plate 110 which remains in the fully retracted position. Once loaded, the internal frame member 60 is pivoted downward within the service compartment 52, the doors 54, 56 are shut and the device 10** is restored to operational status to further dispense more sanitary lids.

As shown if FIG. 3, the device may provide more than one service compartment 52 with the ability to dispense sanitary lids of different sizes from a common device. It is preferred that the device 10 be provided as a table top device for placement near a beverage dispenser. It is also indicated in FIGS. 1 and 3, that there be provided a space below the lower end 96 of the retaining rod 90 of sufficient area to place a beverage cup, bowl or container so that the sanitary lid being dispensed would be able to fall upon the top of the beverage cup, bowl or container, although it is contemplated that the lid may be dispensed into a sanitary hand of an operator. The device may be provided for public use by locating the device in a public access area or use by food service workers behind a counter in a secure area. The device may also include operational contact switches to facilitate the means of causing the device to be inoperable when the doors are open or when the internal frame member is in a horizontal position during loading, not shown. While the invention has been particularly shown and described with reference to a preferred embodiment thereof, it will be understood by those skilled in the art that changes in form and detail may be made therein without departing from the spirit and scope of the invention.

What is claimed is:

1. A sanitary lid dispensing device to provide a dispensing of a single sanitary lid for a beverage container from a plurality of stacked sanitary lids without direct contact by a person serving a beverage, comprising:

a frame structure defining a rear controller enclosure containing operational electronic components required to operate said device and a front service enclosure, an internal frame member within said front service enclosure having a lower end defining a lower flange, an upper frame structure support including an upper surface having a motor cage and an upper flange, a two-directional motor located within said motor cage having an upper spindle extending above said motor cage, a threaded drive shaft defining an outer thread and rotatable secured between said upper flange at an upper end and at a lower end by said lower flange, said upper end terminating into an upper pulley connected to said upper spindle by a drive belt, said motor and said drive belt providing incremental rotation to said threaded drive shaft, a stationary retaining rod having an upper end welded to lower surface of said upper frame structure support and defining a lower end having at least one spaced indentation, said stationary retaining rod being directed through a central bore in each sanitary lid comprising said plurality of stacked sanitary lids, with said central bore of a lowest sanitary lid being engaged within said at least one spaced indentation until dispensed, a press plate providing a lower surface, engaging said outer threads of said threaded drive shaft, wherein rotation of said threaded drive shaft elevates and lowers said press plate within said internal frame member, said press plate having a central hole allowing said stationary retaining rod to pass as said press plate moves within said internal frame member, said press plate applying a downward force upon said plurality of stacked sanitary lids to dispense said lowest sanitary lid from said lower end of said stationary retaining rod, and a presence sensor located within service compartment below said internal frame member which, when activated, activates said operational electronic components to cause said motor to rotate said threaded drive shaft in a programmed incremental amount, urging said press plate downward against said plurality of stacked sanitary lids, forcing said plurality of stacked lids downward along said retaining rod, expelling said lowest lid in from said lower end of said retaining rod within said service compartment.

2. The device as disclosed in claim 1, further comprising:

said press plate having a side bracket attaching to an internally threaded drive ring which engages said outer thread of said threaded drive shaft;

said internal frame member further comprising a lateral stationary support rod attached between a lower surface of said upper frame support platform and said lower end of said internal frame member; and said press plate having a lateral bore providing passage of said lateral stationary support rod through said press plate as said press plate moves within said internal frame member to dispense said plurality of stacked sanitary lids.

3. The device as disclosed in claim 1, further comprising:

said internal frame member is pivotally attached to said front service enclosure at said upper frame structure member and said device is rendered inoperable when said internal frame member is pivoted outside said service enclosure.

4. The device as disclosed in claim 1, further comprising:

said device has more than one segregated front service compartment with each said segregated front service compartment having independently operable internal frame members, two-directional motors, threaded drive shafts, stationary retaining rods having separate pluralities of stacked sanitary lids upon each stationary retaining rod, press plates moving independently along each said threaded drive shaft and individual presence sensors within each service compartment to activate each segregated front service compartment individually.

5. The device as disclosed in claim 1, further comprising:

a lower sensor which send a signal alert to said operational electronic components providing notification when all said plurality of stacked sanitary lids have been dispensed from said stationary retaining rod, with said lower plate sensor being activated by a presence of said press plate near said lower end of said threaded shaft preventing said central hole of said press plate from disengagement with said lower end of said stationary retaining rod, retracting said press plate to a fully retracted position closest to said upper frame support platform ready to load another plurality of stacked sanitary lids.

6. A sanitary lid dispensing device to provide a sanitary lid to a beverage container without contact by a person serving the beverage, comprising:

a frame structure defining a rear controller enclosure providing a controller compartment with a controller access door having an upper hinge attaching said controller access door to a rear panel of said rear controller structure, said controller compartment containing operational electronic components required to operate said device, a front service enclosure providing at least one service compartment with a side door having a side hinge attaching said side door to a side of said frame structure, and an upper door, having a rear hinge attaching said upper door to an upper end of said frame structure;

said at least one service compartment further including an internal frame member, providing an upper frame support platform having an upper surface upon which is mounted a two-directional motor within a motor cage, said motor having an upper end defining an upper spindle above said motor cage, a lateral threaded drive shaft having an upper pulley connected to said upper spindle of said motor by a drive belt, said drive shaft being mounted in a vertical position and having an outer thread along said drive shaft with a lower end of said drive shaft rotatably secured within a lower flange of a lower end of said internal frame member and an upper end of said drive shaft rotatably secured within an upper flange on said upper frame support platform of said internal frame member, a stationary central retaining rod having an upper end welded to a lower surface of said upper frame support platform, said retaining rod further defining a smooth shaft portion with a lower end having a plurality of grooved indentations, each indentation spaced apart at an even distance equal to a distance between a top of each of a plurality of stacked sanitary lids having a central bore inserted upon said retaining rod forming said plurality of stacked sanitary lids, a lateral stationary support rod attached between said lower surface of said upper frame support platform and said lower end of said internal frame member, a press plate having a flat lower surface and a side bracket having an internally threaded drive ring which is threadably engaged to said threaded shaft of said threaded drive shaft traveling vertically up or down said threaded drive shaft as said shaft rotates, said press plate further providing a central hole which glides along said retaining rod without contact and a lateral bore which moves along said lateral stationary support rod, said lateral support rod maintaining said press plate in a horizontal position during its movement within said internal frame member, and a presence sensor located within said service compartment below said internal frame member which, when activated, sends a signal to said operational electronic components causing said motor to rotate said threaded drive shaft in a programmed incremental amount, urging said press plate downward against a top lid in said plurality of stacked sanitary lids forcing said plurality of stacked lids downward along said retaining rod, and expelling a lowest lid in said plurality of stacked lids from said retaining rod onto a beverage container placed below said lower end of said retaining rod.

7. The device as disclosed in claim 6, further comprising:

said internal frame member is pivotally attached to said front service enclosure at said upper frame structure member and said device is rendered inoperable when said internal frame member is pivoted outside said service enclosure.

8. The device as disclosed in claim 6, further comprising:

said device has more than one segregated front service compartment with each said segregated front service compartment having independently operable internal frame members, two-directional motors, threaded drive shafts, stationary retaining rods having separate pluralities of stacked sanitary lids upon each stationary retaining rod, press plates moving independently along each said threaded drive shaft and individual presence sensors within each service compartment to activate each segregated front service compartment individually.

9. The device as disclosed in claim 6, further comprising:

a lower sensor which send a signal alert to said operational electronic components providing notification when all said plurality of stacked sanitary lids have been dispensed from said stationary retaining rod, with said lower plate sensor being activated by a presence of said press plate near said lower end of said threaded shaft preventing said central hole of said press plate from disengagement with said lower end of said stationary retaining rod, retracting said press plate to a fully retracted position closest to said upper frame support platform ready to load another plurality of stacked sanitary lids.

10. The device as disclosed in claim 6, further comprising:

said device has more than one segregated front service compartment with each said segregated front service compartment having independently operable internal frame members, two-directional motors, threaded drive shafts, stationary retaining rods having separate pluralities of stacked sanitary lids upon each stationary retaining rod, press plates moving independently along each said threaded drive shaft and individual presence sensors within each service compartment to activate each segregated front service compartment individually;

each said internal frame member is pivotally attached to said respective front service enclosure at said upper frame structure member and said device is rendered inoperable when any said internal frame member is pivoted outside said service enclosure; and each said service compartment includes a lower sensor which send a signal alert to said operational electronic components providing notification when all said plurality of stacked sanitary lids have been dispensed from said stationary retaining rod within said respective service compartment, with said respective lower plate sensor being activated by a presence of said respective press plate near said lower end of said respective threaded shaft preventing said central hole of said respective press plate from disengagement with said lower end of said respective stationary retaining rod, retracting said respective press plate to a fully retracted position closest to said respective upper frame support platform independently and ready to load another plurality of stacked sanitary lids within said respective service compartment.

* * * * *